US007380637B2

(12) United States Patent
Sieben et al.

(10) Patent No.: US 7,380,637 B2
(45) Date of Patent: Jun. 3, 2008

(54) EXHAUST-GAS MUFFLER

(75) Inventors: Guilherme Pizzato Sieben, Porto Alegre (BR); Ralf Blechschmidt, Kernen (DE); Helmut Schlessmann, Prüm (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 432 days.

(21) Appl. No.: 11/013,439

(22) Filed: Dec. 17, 2004

(65) Prior Publication Data

US 2005/0139418 A1 Jun. 30, 2005

(30) Foreign Application Priority Data

Dec. 24, 2003 (DE) ..... 103 61 216

(51) Int. Cl.
*F01N 1/02* (2006.01)
*F01N 7/10* (2006.01)

(52) U.S. Cl. ..... 181/240; 181/264; 181/268; 181/269; 181/272; 181/265; 60/299; 60/300; 60/301; 60/302

(58) Field of Classification Search ..... 181/240, 181/264, 268, 269, 272, 265; 61/299, 300, 61/301, 302; 60/299, 300, 301, 302
See application file for complete search history.

(56) References Cited

U.S. PATENT DOCUMENTS 3,168,936 A * 2/1965 Gordon ..... 181/269
3,650,354 A * 3/1972 Gordon ..... 181/240
3,741,730 A * 6/1973 Alcott ..... 422/173
3,798,769 A * 3/1974 Bailey ..... 30/383
3,968,854 A 7/1976 Gordon et al.
4,370,855 A * 2/1983 Tuggle ..... 60/317
4,418,790 A * 12/1983 Agnew ..... 181/268
4,579,194 A * 4/1986 Shiki et al. ..... 181/231
4,854,417 A * 8/1989 Uesugi et al. ..... 181/272
4,867,270 A * 9/1989 Wissmann et al. ..... 181/231
4,972,921 A * 11/1990 Takada et al. ..... 181/282
5,048,290 A * 9/1991 Lavenius et al. ..... 60/299
5,109,949 A * 5/1992 Sato et al. ..... 181/240
5,146,052 A * 9/1992 Dummel ..... 181/240
5,483,931 A * 1/1996 Stoll et al. ..... 123/185.3
5,857,327 A * 1/1999 Sato et al. ..... 60/302
5,883,342 A * 3/1999 Wolpert ..... 181/230

(Continued)

FOREIGN PATENT DOCUMENTS

JP 03290071 A * 12/1991

*Primary Examiner*—Lincoln Donovan
*Assistant Examiner*—Jeremmy Luks
(74) *Attorney, Agent, or Firm*—Walter Ottesen

(57) ABSTRACT

The invention is directed to an exhaust-gas muffler (1) of a handheld work apparatus driven by an internal combustion engine. The exhaust-gas muffler (1) includes a muffler housing (2) which includes an engine-end wall (3) having an inlet window (4) as well as an outlet (5). Attachment means (6) for fixing the exhaust-gas muffler (1) on the internal combustion engine are provided on the engine-end wall (3) in the region of the inlet window (4). The engine-end wall (3) is provided with a reinforcing sheet metal piece (7) on the inner side of the exhaust-gas muffler (1) in the region of the attachment device (6). A discharge channel (8), which leads to the outlet (5), is formed at least between a part region of the reinforcing sheet metal piece (7) and the adjoining region of the muffler housing (2).

12 Claims, 2 Drawing Sheets

U.S. PATENT DOCUMENTS 6,044,926 A * 4/2000 Yamane et al. ..... 181/230
6,250,075 B1 * 6/2001 Funakoshi et al. ..... 60/299
6,422,338 B1 * 7/2002 Menzel et al. ..... 181/230
6,789,644 B2 * 9/2004 Mukaida ..... 181/272
6,910,550 B2 * 6/2005 Schlossarczyk et al. .... 181/283
6,955,043 B2 * 10/2005 Schlossarczyk et al. ..... 60/299
7,174,991 B1 * 2/2007 Gunnarsson et al. ..... 181/231
2003/0085072 A1 * 5/2003 Mukaida ..... 181/272
2003/0173148 A1 * 9/2003 Andersson et al. ..... 181/272
2005/0155818 A1 * 7/2005 Wirtz ..... 181/269

* cited by examiner

EXHAUST-GAS MUFFLER

CROSS REFERENCE TO RELATED APPLICATION

This application claims priority of German patent application no. 103 61 216.5, filed Dec. 24, 2003, the entire content of which is incorporated herein by reference.

FIELD OF THE INVENTION

The invention relates to an exhaust-gas muffler of a portable handheld work apparatus driven by an internal combustion engine.

BACKGROUND OF THE INVENTION

Exhaust-gas mufflers of this kind are, for example, of motor-driven chain saws, suction/blower apparatus, brush-cutters or the like and are flange connected directly to the cylinder of. the engine. A muffler housing of the exhaust-gas muffler has attachment means, especially, in the form of flange screws which are provided on the engine-end wall of the muffler housing. The attachment means are in the immediate proximity of an inlet window through which the hot exhaust gases of the engine flow into the interior of the exhaust-gas muffler. The hot and pulsating exhaust-gas flow generates considerable thermal and mechanically vibrating loads in the attachment means and especially in the engine-end wall of the muffler housing.

Overall, a low weight is sought for a good manipulability of the work apparatus. With a view to a low overall weight, the walls of the muffler housing are designed to be thin. A low muffler weight leads especially to a mechanical loading of the attachment means and the engine-end wall under vibration load. A thin-walled design of the engine-end wall is disadvantageous because of the low bending stiffness thereof which permits an elastic deformation transverse to the wall plane. For corresponding thermal and/or mechanical loading, the stress of the engine-end wall because of bending load, curving load and/or torsion load can be disadvantageous.

Exhaust-gas mufflers are known wherein the engine-end wall is provided with a support disc on the inner side of the muffler housing in the region of the attachment means. The support disc is intended to lead to a local reinforcement of the engine-end muffler wall and to a planar introduction of the screw forces. To achieve an adequate reinforcement effect, a corresponding thickness of the support disc is required which operates disadvantageously on the total weight of the exhaust-gas muffler. Stress peaks in the region of the edges of the support discs are avoidable only to a limited extent.

SUMMARY OF THE INVENTION

It is an object of the invention to provide an exhaust-gas muffler of the kind described above which is so improved that a better operating performance results.

The exhaust-gas muffler of the invention is for a handheld work apparatus driven by an internal combustion engine. The exhaust-gas muffler includes: a housing defining an interior and including an engine-end wall defining an inlet opening through which exhaust gas enters the muffler; the engine-end wall further including an outlet through which the exhaust gas discharges from the muffler; attachment means for fixing the exhaust-gas muffler on the engine arranged in the region of the inlet window; a reinforcing sheet metal piece disposed in the interior so as to extend at least approximately over the surface of the engine-end wall; the housing having a part region adjoining a component region of the reinforcing sheet metal piece; and, the component region of the reinforcing sheet metal piece and the part region of the housing conjointly defining a discharge channel leading to the outlet.

A reinforcing sheet metal piece is provided on the inner side of the exhaust-gas muffler in the region of the attachment means with this reinforcement sheet metal piece extending at least approximately over the surface of the engine-end wall. A discharge channel leading to the outlet is formed at least between a part region of the reinforcement sheet metal piece and the adjacent region of the muffler housing. The cross section of the discharge channel is at least partially delimited on the outside by the corresponding part region of the reinforcement sheet metal piece and the adjacent region of the muffler housing. The engine-end wall is supported over the entire surface while avoiding stress peaks. The hollow cross section, which is formed by the discharge channel, leads to a high stiffness of the muffler housing in the region of the engine-end wall also for a very thin-walled and therefore weight-saving configuration. This engine-end wall has a low deformation and low stress also for high thermal and/or mechanical loads. Leakages in the region of the inlet window as well as excessive material loading are avoided. The throughflow of the hollow space, which defines the discharge channel, with exhaust gases causes the volume of the discharge channel to be part of the volume of the muffler. A pregiven total muffler volume can be maintained without additional measures. Overall, there results a space-saving and compact configuration. The flow guidance of the exhaust-gas flow is improved with corresponding designs of the discharge channel.

The reinforcement sheet metal piece is clampingly held in the muffler housing in an advantageous embodiment of the invention. The reinforcing sheet metal piece is bent over especially at least in part regions of its edges in such a manner that the reinforcing sheet metal piece with bent-over side surfaces lies resiliently against peripheral walls of the muffler housing. The clamping fixation of the reinforcing sheet metal piece simplifies the assembly. The resilient contact engagement of the bent-over side surfaces leads to a fixing which retains a corresponding pressing force with a corresponding prestress force even at high vibration loads. Vibration caused noises are avoided. Overall, there results a surface configuration of the reinforcing sheet metal piece which avoids stress peaks in combination with the support against the peripheral walls.

In a practical embodiment, the attachment means include screw holes in the engine-end wall as well as screw receiving tubes which lead through the muffler housing with the screw receiving tubes adjoining the screw holes. The reinforcing sheet metal piece is clampingly held between the engine-end wall and the screw receiving tubes. The screw receiving tubes are correspondingly stiff in the longitudinal direction. The reinforcing sheet metal piece is reliably pressed with its surface against the engine-end muffler wall.

The screw receiving tube advantageously has an inner flange lying with its surface on the reinforcing sheet metal piece. An attachment screw, which is introduced into the screw receiving tube, lies with its screw head in surface contact against the inner flange in the screwed-in state of the exhaust-gas muffler. The reinforcing sheet metal piece as well as the engine-end muffler wall are reliably clamped with a corresponding screw pretension force between the inner flange and a corresponding cylinder-end flange. A relative displacement of the reinforcing sheet metal piece with reference to the engine-end wall and therefore a wall deformation associated therewith is reliably avoided.

In an advantageous embodiment, the reinforcing sheet metal piece lies seal-tightly against the muffler housing in the region of the discharge channel. The discharge channel has an input window. The seal-tight contact generates, on the one hand, a good mechanical support of the reinforcing sheet metal piece and; on the other hand, a precise guidance of the exhaust-gas flow in the discharge channel is ensured in combination with the input window.

The input window is configured as an input spray device with the input spray device being especially part of the reinforcing sheet metal piece. The input spray device functions as a protection against sparks. In combination with an adequate length of the discharge channel, an exiting of sparks from the discharge is reliably avoided. Furthermore, the input spray device contributes to a swirling of the exhaust-gas flow. The swirled exhaust-gas flow exits diffusedly from the discharge and mixes with the ambient air after a short running distance. Temperature peaks in the outside exhaust-gas flow are avoided. The configuration of the input spray device as part of the reinforcing sheet metal piece avoids the complexity of additional components.

In an advantageous embodiment, the discharge channel is delimited about its periphery by channel walls. At least one channel wall is formed by a curved region of the reinforcing sheet metal piece. The curving of the reinforcing sheet metal piece generates a corresponding channel cross section. Additional curving in one or several housing walls is unnecessary. A pregiven compact outer contour of the exhaust-gas muffler is retained. One channel wall and/or a further channel wall is formed by the engine-end muffler wall or by a muffler peripheral wall. The discharge channel runs either along the engine-end housing wall or along one or several peripheral walls and/or along the angled region wherein the peripheral walls adjoin the engine-end housing wall. Especially in an embodiment wherein the corresponding channel walls are formed by the peripheral walls as well as by the engine-end wall, a correspondingly long discharge channel is formed also for a compact configuration of the muffler. The discharge channel runs at least approximately over the length of two mutually adjoining peripheral walls with this length being measured in the peripheral direction. The long running length of the exhaust-gas flow in the discharge channel contributes to a clean flow guidance. The comparatively long length of the discharge channel can lead to a performance-increasing resonance effect.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
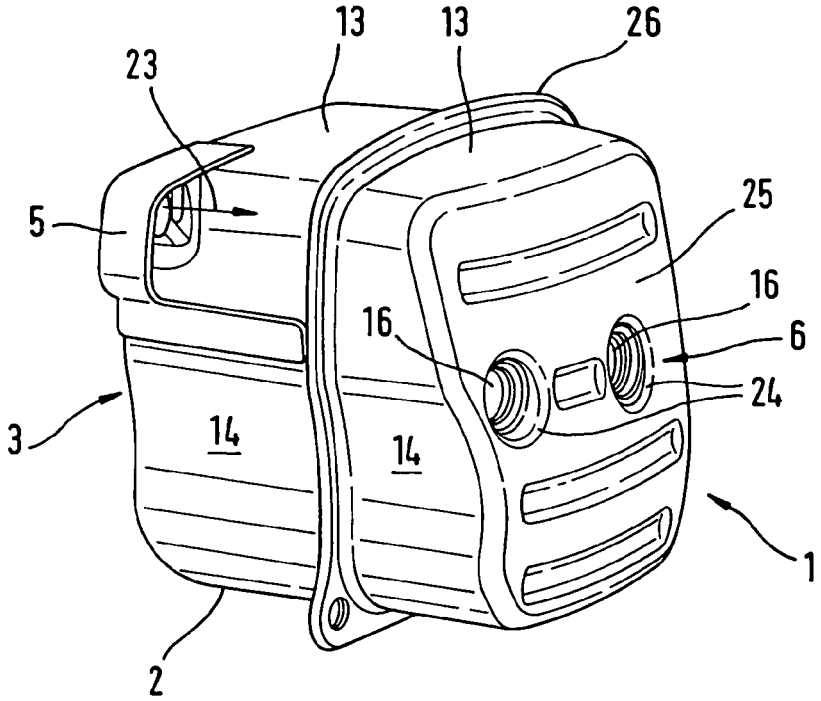
FIG. 1 is a perspective view of an exhaust-gas muffler having two screw receiving tubes passing through the muffler housing.

FIG. 1 shows a perspective view of an exhaust-gas muffler 1 of a handheld work apparatus driven by an internal combustion engine. The exhaust-gas muffler 1 includes a muffler housing 2 which is configured approximately as a cube. An interior space of the exhaust-gas muffler 1 is surrounded by an engine-end wall 3 and an opposite-lying front wall 25 as well as by peripheral walls (13, 14) of the muffler housing 2. The front wall 25 includes two openings 24 from which respective screw receiving tubes 16 extend through the muffler housing 2 up to the engine-end wall 3. Attachment screws (not shown) can be introduced into the screw receiving tubes 16 for fixing the exhaust-gas muffler 1 on the engine. The screw receiving tubes 16 are then part of attachment means 6 of the exhaust-gas muffler 1.

The muffler housing 2 is configured as two shells in the embodiment shown. The two sheet metal shells are joined to each other by a peripherally-extending folded joint 26. A scoop-shaped outlet 5 is provided in the corner region between the peripheral walls (13, 14) and the engine-end housing wall 3. During operation, an exhaust-gas flow flows through the outlet 5 in the direction of arrow 23, that is, in the direction of the front wall 25.

Figure 2:
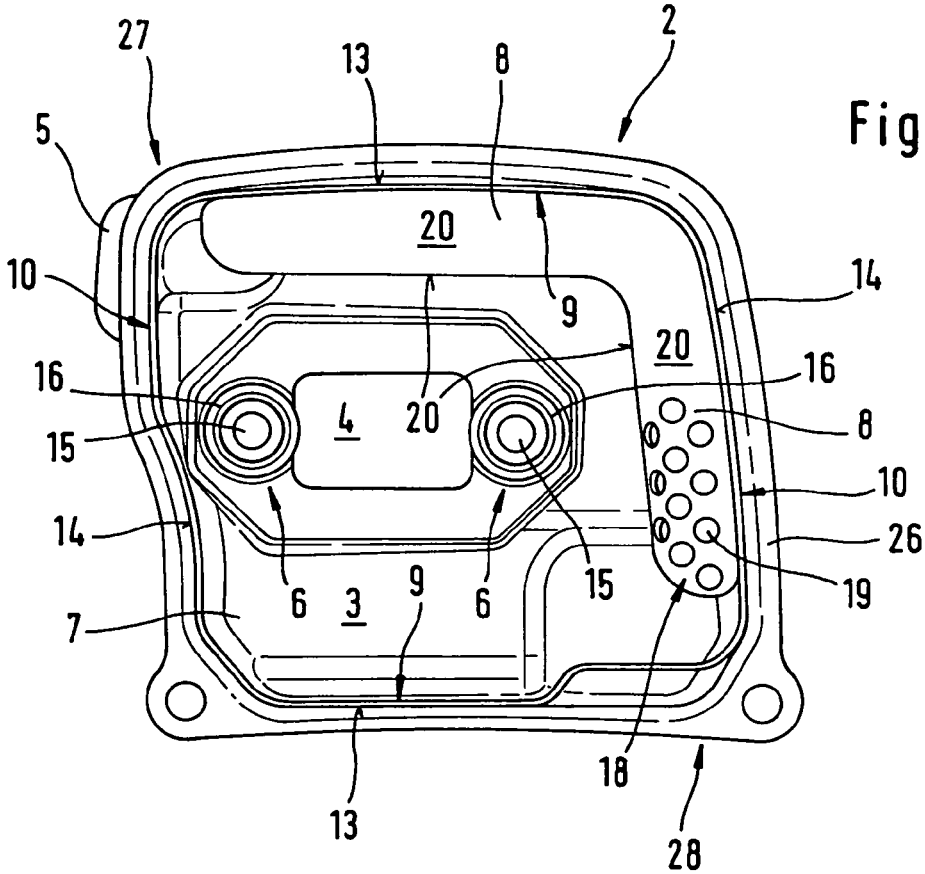
FIG. 2 is an interior view and shows the engine-end wall of the exhaust-gas muffler of FIG. 1 with a reinforcing sheet metal piece and an L-shaped discharge channel formed in the reinforcing sheet metal piece; and, FIG. 3 is a longitudinal section view of the exhaust-gas muffler of FIG. 1 with details as to the cross-sectional configuration of the exhaust-gas channel.

In an inside view, FIG. 2 shows the exhaust-gas muffler 1 of FIG. 1 in the region of its engine-end wall 3. The engine-end wall 3 has an approximately centered inlet window 4 for an exhaust-gas flow as well as screw holes 15 on respective sides thereof. The screw holes 15 are surrounded seal-tightly by the screw receiving tubes 16. The screw receiving tubes 16 open seal-tightly into the openings 24 of the front wall 25 (FIG. 1). As a consequence, the interior of the screw receiving tube 16 is free of exhaust gases.

On the interior side of the muffler housing 2, a reinforcing sheet metal piece 7 lies partially in surface contact against the engine-end wall 3. In the cross section shown, the reinforcing sheet metal piece 7 has a peripheral contour which corresponds to the contour of the engine-end wall 3. The reinforcing sheet metal piece 7 has opposite-lying edges (9, 10) and is bent over at these edges. The reinforcing sheet metal piece 7 lies with these edges (9, 10) seal-tightly against corresponding ones of the opposite-lying peripheral walls (13, 14) of the muffler housing 2.

An approximately L-shaped part region of the reinforcing sheet metal piece 7 is so curved inwardly that this component region is at a spacing to the engine-end wall 3 as well as to the adjoining peripheral walls (13, 14) in such a manner that an L-shaped discharge channel 8 is formed. The discharge channel 8 leads from the interior of the muffler housing 2 to the outlet 5.

An embodiment can be practical wherein the reinforcing sheet metal piece 7 defines a gap with respect to the walls (3, 13, 14) of the muffler housing 2 through which the exhaust-gas flow can reach the interior of the discharge channel 8. In the embodiment shown, the reinforcing sheet metal piece 7 lies seal-tightly against the adjoining peripheral walls (13, 14) in the region of the discharge channel 8 and is provided with a defined input window 18. The input window 18 opens at the front end into the discharge channel 8. In the embodiment shown, channel walls 20 of the discharge channel 8 are so apertured that an input window 18 in the form of an input spray device 19 is formed. The channel walls 20 and the input spray device 19 are formed in the reinforcing sheet metal piece 7 configured as one piece.

In the embodiment shown, the input window 18 is arranged in the region of a corner 28 of the engine-end wall 3. The above-mentioned corner 28 lies diagonally to the corner 27 in the region of the outlet 5. The discharge channel 8 then runs at least approximately over the length of the two mutually adjoining peripheral walls (13, 14) with this length being measured in the peripheral direction. As may be required, the discharge channel can also run over the length of three or four peripheral walls (13, 14) or can be configured shorter.

Figure 3:
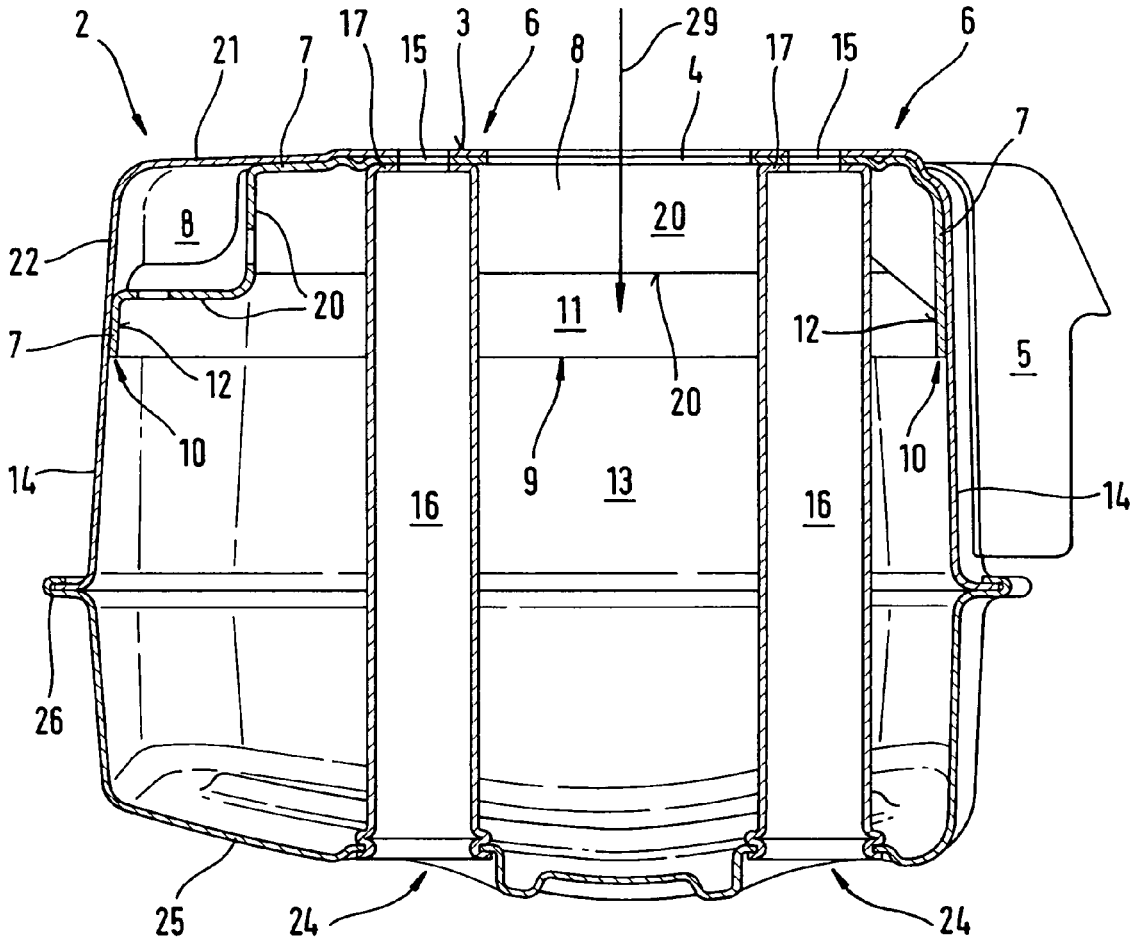

FIG. 3 shows a longitudinal section view of the exhaust-gas muffler 1 of FIG. 1. From the embodiment shown, it can be seen that the two screw receiving tubes 16 are flange connected with the front wall 25 in the region of the openings 24. At the ends, which adjoin the engine-end wall 3, the screw receiving tubes 16 have an inner flange 17 which is in surface contact against the reinforcing sheet metal piece 7. The reinforcing sheet metal piece 7 itself lies in surface contact against the engine-end wall 3 except for the discharge channel 8. The reinforcing sheet metal piece 7 is clampingly held between the inner flange 17 and the engine-end wall 3. In the screw mounted state of the muffler housing 2, a screw head of a screw (not shown), which extends through the corresponding screw hole 15, lies on the inside in surface contact on the inner flange 17. The reinforcing sheet metal piece 7 and the engine-end wall 3 are clampingly held between the inner flange 17 and the cylinder flange (not shown) which lies outside against the engine-end wall 3.

The reinforcing sheet metal piece 7 is bent over in the region of the edges (9, 10) in such a manner that side portions (11, 12) formed because of the bend lie resiliently against respective ones of adjoining peripheral walls (13, 14) of the muffler housing 2. The reinforcing sheet metal piece 7 is overall clampingly held in the muffler housing 2. Alternatively or in combination therewith, a fixing of the reinforcing sheet metal piece 7 can be provided by welding, soldering or the like.

In the embodiment shown, the discharge channel 8 has an approximately square cross section which is delimited in the direction of the interior side of the muffler housing 2 by two channel walls 20, which are at right angles to each other, and is delimited in the direction of the outer side by channel walls (21, 22). The two outer channel walls (21, 22) are formed by the engine-end wall 3 and by the peripheral walls (13, 14).

The engine-end wall 3 and the peripheral walls (13, 14) are essentially configured to be planar and have no additional shaping in the region of the channel walls (21, 22).

Advantageously, it can be provided by corresponding shaping to form the discharge channel 8 in the engine-end wall 3 and/or in the peripheral walls (13, 14). The reinforcing sheet metal piece 7 can be planar or can be configured in the manner described hereinafter.

In the angle region between the engine-end wall 3 and the adjoining peripheral walls (13, 14), the reinforcing sheet metal piece 7 is so curved inwardly that the two channel walls 20 are formed. The channel walls 20 meet approximately at right angles to the respective peripheral walls (13, 14). The side portions (11, 12) of the reinforcing sheet metal piece 7 are bent over approximately at right angles from the channel walls 20 in such a manner that they lie in surface contact and resiliently against the peripheral walls (13, 14). The corresponding edges (9, 10) lie outside of the discharge channel 8. The side portions (11, 12) can be so bent over at an angle that the edges (9, 10) lie at the inner side of the discharge channel 8.

In addition to the embodiment shown, embodiments can be practical wherein the cross section of the discharge channel 8 is delimited by the channel walls 20 of the reinforcing sheet metal piece 7 in combination only with the engine-end wall 3 or only with the corresponding peripheral walls (13, 14). It is also possible that the cross section of the discharge channel 8 is completely or at least partially formed into the muffler housing 2. If required, an arching or curving of the reinforcing sheet metal piece 7 directed inwardly can be omitted. The invention can also be carried out together with an exhaust-gas muffler 1 which is provided with an exhaust-gas catalytic converter. A catalytic converter of this kind can, for example, be arranged on the inner side of the muffler housing 2 in the region of the peripherally-extending folded joint 26. Appropriate means are provided so that the exhaust-gas flow from the inlet window 4 is first conducted through the catalytic converter and then guided to the discharge channel 8.

It is understood that the foregoing description is that of the preferred embodiments of the invention and that various changes and modifications may be made thereto without departing from the spirit and scope of the invention as defined in the appended claims.

What is claimed is:

1. An exhaust-gas muffler for a handheld work apparatus driven by an internal combustion engine, the exhaust-gas muffler comprising:

a housing defining an interior space of the exhaust gas muffler;

said housing being configured as two shells and comprising an engine-end wall, an opposite lying front wall and peripheral side walls connecting said engine-end wall to said front wall;

said engine-end wall, said front wall and said peripheral side walls conjointly surrounding said interior space;

said engine-end wall defining an inlet opening window through which exhaust gas enters the muffler;

said engine-end wall further including an outlet through which the exhaust gas discharges from said muffler;

said engine-end wall having a first corner in the region of said outlet and further having a second corner lying diagonally to said first corner;

attachment means for fixing said exhaust-gas muffler on said engine arranged in the region of said inlet window;

a reinforcing sheet metal piece disposed in said interior so as to extend at least approximately over the surface of said engine-end wall;

said housing having a part region adjoining a component region of said reinforcing sheet metal piece;

said component region of said reinforcing sheet metal piece and said part region of said housing conjointly defining a discharge channel;

said discharge channel having an input window and said input window being arranged in the region of said second corner of said engine-end wall;

said discharge channel being configured to have an L-shaped course and to run over the length of said two mutually adjoining peripheral side walls with said length measured in a peripheral direction along said mutually adjoining peripheral side walls; and, said discharge channel leading to said outlet in the area of said first corner of said engine-end wall.

2. The exhaust-gas muffler of claim 1, wherein said reinforcing sheet metal piece is clamped in said housing.

3. The exhaust-gas muffler of claim 2, wherein said housing includes first and second peripheral walls; and, said reinforcing sheet metal piece has first and second edges and said reinforcing sheet metal piece has part regions bent over at said first and second edges to form first and second bent-over side portions which are in elastic resilient contact engagement with said first and second peripheral walls.

4. The exhaust-gas muffler of claim 3, wherein said attachment means include screw holes in said engine-end wall and screw receiving tubes extending through said housing to border on and adjoin corresponding ones of said screw holes; and, said reinforcing sheet metal piece is clampingly held between said engine-end wall and said screw receiving tubes.

5. The exhaust-gas muffler of claim 4, wherein each of said screw receiving tubes includes an inner flange lying in surface contact against said reinforcing sheet metal piece.

6. The exhaust-gas muffler of claim 1, wherein said reinforcing sheet metal piece lies in seal-tight engagement with said housing in the region of said discharge channel and said discharge channel has an input window.

7. The exhaust-gas muffler of claim 6, wherein said input window is configured as an input spray device.

8. The exhaust-gas muffler of claim 7, wherein said input spray device is part of said reinforcing sheet metal piece.

9. The exhaust-gas muffler of claim 1, wherein said discharge channel is peripherally defined by channel walls and a first one of said channel walls is configured by a curved region of said reinforcing sheet metal piece.

10. The exhaust-gas muffler of claim 9, wherein a second one of said channel walls is defined by said engine-end wall.

11. The exhaust-gas muffler of claim 10, wherein said housing includes first and second peripheral walls; and, a third one of said channel walls is formed by at least one of said peripheral walls.

12. The exhaust-gas muffler of claim 1, wherein said discharge channel runs over the entire length of said two mutually adjoining peripheral side walls.

* * * * *